US006106671A

United States Patent [19]

Heaven et al.

[11] Patent Number: 6,106,671

[45] Date of Patent: Aug. 22, 2000

[54] INTELLIGENT GAP CONTROL FOR IMPROVED PAPER MACHINE PROFILE CONTROL

[75] Inventors: Edwin Michael Gyde Heaven, North Vancouver; Robert Bucher, West Vancouver; Ron I. Powell, North Vancouver, all of Canada

[73] Assignee: Honeywell Measurex Devron Inc., North Vancouver, Canada

[21] Appl. No.: 09/070,472

[22] Filed: Apr. 30, 1998

[51] Int. Cl.[7] ..... D21F 11/00

[52] U.S. Cl. ..... 162/198; 162/263; 162/344; 162/346; 162/347; 118/671; 118/672; 118/712; 425/145; 425/150; 425/171; 425/466

[58] Field of Search ..... 162/198, 259, 162/262, 263, 344–347; 118/670–672, 712, 664; 156/378; 427/8; 340/686, 690; 364/471.01, 471.02, 471.03; 74/470; 73/316, 159, 340, 690, 626, 768, 781; 356/375, 384–387, 398; 425/145, 141, 150, 171, 466

[56] References Cited

U.S. PATENT DOCUMENTS

| | | | |
|---|---|---|---|
| 3,940,221 | 2/1976 | Nissel | 424/141 |
| 4,517,055 | 5/1985 | Dove | 162/344 |
| 4,726,883 | 2/1988 | Schroeder | 162/259 |
| 4,770,744 | 9/1988 | Dove | 162/259 |
| 4,832,794 | 5/1989 | Lyytinen | 162/198 |
| 4,833,941 | 5/1989 | Leppanen et al. | 74/625 |
| 4,854,844 | 8/1989 | Carlsen | 425/141 |
| 5,009,748 | 4/1991 | Balakrishnan et al. | 162/198 |
| 5,096,542 | 3/1992 | Dove | 162/259 |
| 5,298,123 | 3/1994 | Van Den Woldenberg | 162/259 |
| 5,382,146 | 1/1995 | Krüger et al. | 425/141 |
| 5,423,668 | 6/1995 | Cloeren | 425/141 |
| 5,457,539 | 10/1995 | Sturm | 356/429 |
| 5,953,125 | 9/1999 | Groot | 356/357 |

OTHER PUBLICATIONS

Recent Experiences with Consistency Profile Control Installations—Mike Heaven; Robert Vyse; Tom Steele and Claud Hagart–Alexander—Presented at the CPPA Technical Section Pacific and Western Branch Joint Conference, Whistler, Canada May 1997 pp. 1–10).

*Primary Examiner*—Stanley S. Silverman
*Assistant Examiner*—Jose A. Fortuna
*Attorney, Agent, or Firm*—Christie, Parker & Hale, LLP

[57] ABSTRACT

Apparatus and method for controlling the size of a gap through which material is metered. The gap is defined by a rigid surface and a flexible surface connected to at least one actuator for deforming the flexible surface. A plurality of sensors are positioned along the rigid or flexible surfaces to detect the other of the surfaces and generate signals indicating its position. A computing unit in communication with the plurality of sensors processes the signals to generate a continuous gap measurement profile. The computing system also stores a pre-determined desired gap measurement profile. A control system in communication with the computing unit actuates the actuators to deform the flexible surface to adjust the gap measurement profile to correct any deviation from the desired gap measurement profile.

18 Claims, 2 Drawing Sheets

INTELLIGENT GAP CONTROL FOR IMPROVED PAPER MACHINE PROFILE CONTROL

FIELD OF THE INVENTION

This invention relates generally to a system for gap regulation in equipment in which a sheet of material is being manufactured involving passage of material through a space or gap. The invention finds particular application in adjustment of the slice lip in papermaking machinery.

BACKGROUND OF THE INVENTION

Traditional cross direction (CD) profile control in the papermaking industry relies on a supervisory level of control based on data acquired by downstream scanning sensors to measure sheet properties such as weight, moisture and caliper. The measured sheet properties are then used to manipulate upstream actuators distributed across the sheet to correct deviation from a desired target profile for a particular measured property. The scanning sensors are usually located at the dry end of the paper machine and it can take several minutes for the scanners to detect changes in the sheet made by the actuators located at the wet end of the machine due to the delay in the paper sheet travelling from the actuators to the sensors.

In paper making machinery, stock which is essentially a fibre suspension is fed from the head box through a gap or elongate orifice whose configuration can be controlled by actuators onto the wire section. The gap is a relatively narrow opening that extends across the width of the machine. The major components that make up the orifice comprise a bottom section, referred to as the apron, and a top section, referred to as the slice lip. Weight profile control in such an arrangement is generally achieved by adjusting the position of the slice lip across the machine with motorized actuators to vary the shape of the gap or orifice. The actuators usually have some form of feedback of the position of the actuators relative to some "zero" position. Applicant is aware of a number of patents directed to actuators and control systems for manipulating the slice lip as follows:

U.S. Pat. No. 4,517,055

U.S. Pat. No. 4,770,744

U.S. Pat. No. 4,883,941

U.S. Pat. No. 5,096,542

These actuators and control systems are conventional in that they rely on downstream scanners providing control signals to independently adjust the position of each actuator in order to adjust the measured profile toward a desired target.

In the past few years, new weight profile control systems have been developed which locally dilute the stock in the headbox using dilution actuators which are controlled by the downstream scanning actuators. In both conventional and new systems, the desire is a uniform profile across the sheet when measured by the scanning system. Since the fibre distribution in the stock depends on the stock consistency across the head box and on the slice-to-apron opening across the machine, it is necessary to ensure a uniform opening from the slice lip to the apron. Most dilution profile control systems are purchased to provide narrower CD profile control than conventional slice lip control systems and to provide uniform fibre orientation across the sheet since the slice-to-apron opening (gap) can be held constant in theory. In practice, it has been found that it is very difficult to maintain a uniform slice-to-apron opening due to thermal, mechanical and other instabilities, and it continues to be necessary to adjust the gap for fiber orientation and, in some cases, for weight profile control.

SUMMARY OF THE INVENTION

To address the foregoing problems, applicant has developed a method and apparatus for directly measuring the slice-to-apron opening while under normal operating conditions and maintaining the opening constant across the sheet with motorized actuators in a local control loop that co-operates with the supervisory level of control exerted by the downstream scanners. Preferably, the actuators are the same as those that are manipulated by profile measurements from the scanning system.

Accordingly, the present invention provides in apparatus for controlling the size of a gap through which material is metered, the gap being defined by a rigid surface and a flexible surface connected to at least one actuator for deforming said flexible surface, the improvement comprising:

a plurality of sensors positioned along one of the rigid and the flexible surfaces to detect the other of the surfaces and generate signals indicating the position of the other of the surfaces;

computing means in communication with the plurality of sensors to process the signals to generate a continuous gap measurement profile and to store a pre-determined desired gap measurement profile; and control means in communication with the computing means to actuate the at least one actuator to deform the flexible surface to adjust the gap measurement profile to correct deviation from the desired gap measurement profile.

In a further aspect, the present invention provides a method for controlling the size of a gap through which material is metered, the gap being defined by a rigid surface and a flexible surface connected to at least one actuator for deforming said flexible surface, comprising the steps of:

detecting one of the rigid and the flexible surfaces by sensors located in the other of the surfaces and generating signals indicating the position of the other of the surfaces;

analyzing the signals generated by the plurality of sensors to generate a continuous gap measurement profile;

comparing the gap measurement profile to a pre-determined desired gap measurement profile; and manipulating the at least one actuator to deform the flexible surface to adjust the gap measurement profile to correct deviations from the desired measurement profile.

The apparatus and method of the present invention offer local regulatory control of the gap through which the material passes. The supervisory level of control based on the downstream scanner measurements is used to bias the regulatory control necessary to correct any remaining variability not removed by maintaining a desired gap measurement profile.

With the apparatus and method of the present invention in combination with dilution profile control systems, it is possible to ensure uniform fiber orientation with gap regulation and uniform weight profile with the dilution actuators.

Gap regulation can also be managed to a desired gap measurement profile determined by the operator. For example, the optimal gap profile might involve a different opening at the edges of the machine than in the centre for uniform flow or some other measured sheet property such as a desired CD fiber orientation profile.

The gap regulation of the present apparatus and method can also be used to maintain the gap at the desired gap measurement profile during upsets or machine changes for quicker production of saleable product after re-starting of the machine.

In cases without dilution control, the slice-to-apron measurements can be used to optimize the gap when the paper machine is started and the temperature of the headbox is increased to ensure as uniform a weight profile as possible before the scanner even sees the sheet under manufacture.

Furthermore, if there is an optical, physical or other measure of the weight on the wire, the gap regulation of the present invention can be adjusted to flatten the sheet profile and display the gap necessary to do so thereby offering a large improvement in visibility and a significant reduction in startup losses to the operator.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
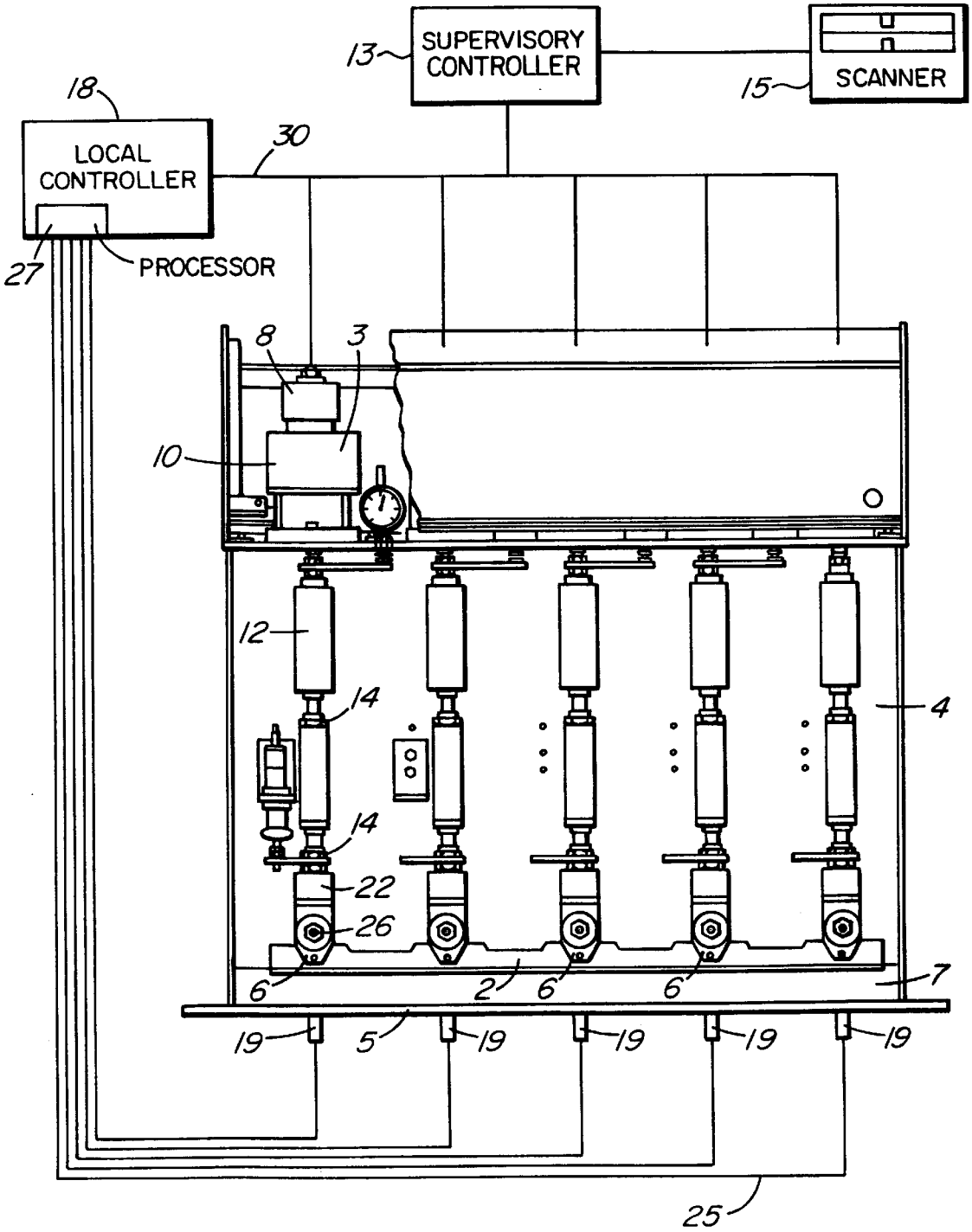
FIG. 1 is a view of a slice lip control system according to a first embodiment of the present invention in which sensors are installed in the apron.

Referring to FIG. 1, there is shown, by way of example, the headbox 4 of a paper machine having a slice lip 2 that incorporates the gap regulation system of the present invention. The slice lip 2 comprises a flexible, deformable surface having a lower edge that is positioned above a rigid surface in the form of apron 5 to define a gap 7 through which stock is metered. A series of conventional actuators 3 are connected at 6 by clamping brackets 26 to slice slip 2. Actuators 3 comprise an air or electric motor 8 attached to a harmonic drive 10. Each actuator also includes a link rod comprising a force limiter 12 and a double-threaded connection 14 that connects to clamping bracket 26. In a conventional arrangement, each actuator 3 is operated in response to signals from a supervisory control 13 system which relies on measurements acquired by downstream scanning sensors 15. Actuators 3 are precisely extended or retracted in order to deform the adjacent region of the attached slice lip 2 to correct deviation from a desired target profile measured in the sheet being produced.

In a first embodiment of the gap regulation system of the present invention, sensors 19 are installed in apron 5 in the cross direction of the machine. Preferably, each sensor is positioned directly below an actuator 3. Sensors 19 are preferably inductive proximity sensors that detect slice lip 2 across gap 7 and generate signals indicating the distance to the slice lip. The signals generated at sensors 19 are communicated through wires 25 to a local controller 18. Included in controller 18 is computing means in the form of a processor 27 that analyzes the sensor signals to generate a continuous gap measurement profile. Controller 18 also stores a pre-determined desired gap measurement profile. It will be readily apparent that other sensors can be used in the apparatus of the present invention including capacitive, ultrasonic, or laser sensors.

In a local regulatory control loop, controller 18 communicates in a conventional manner by lines 30 with actuators 3. Appropriate control signals are sent to manipulate the actuators to deform lip 2 to adjust the gap measurement profile to correct any deviation from the desired gap measurement. Supervisory controller 13 using downstream scanner measurements works in conjunction with local controller 18 to bias the local regulatory control to correct any remaining variability not removed by maintaining a desired gap measurement profile. In the case of new weight profile control systems that rely on dilution actuators, the additional dilution actuators (not shown) act to deliver water to control zones across the head box to maintain a uniform flow rate across the machine in order to avoid cross flows that introduce variation into the CD fibre orientation profile. Generally, the dilution actuators rely on injection valves (rotary or linear) that operate based on setpoints established by the supervisory control system. These additional dilution control actuators are also controlled by supervisory controller 13 using downstream scanner measurements. Like the slice lip actuators 3, the dilution actuators are operated by supervisory controller 13 in conjunction with local controller 18.

Figure 2:
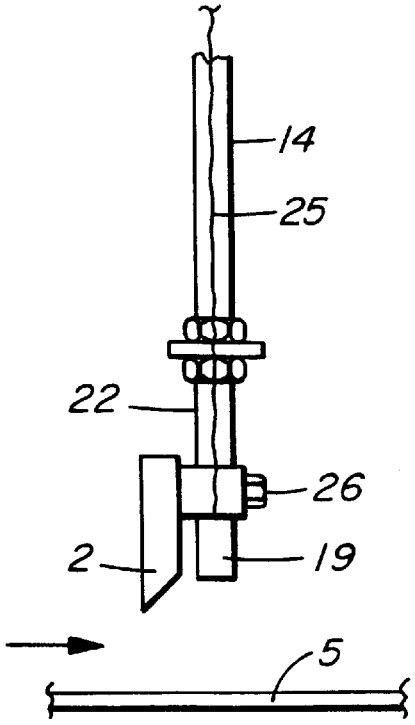
FIG. 2 is a detail view of an alternative embodiment in which the sensors are installed in the mounting clamp between the slice lip and the actuator.

FIG. 2 is a detail view of the lower end of an actuator 3 in which the same parts as those shown in FIG. 1 are identically labelled. FIG. 2 shows an alternative arrangement of the apparatus of the present invention in sensors 19 are mounted to clamping bracket 26 and measure the gap to apron 5. Preferably, wires 25 are fed through a passage in the actuator control rod. This arrangement has the advantage that the sensors are readily accessible for maintenance purposes.

Figure 3:
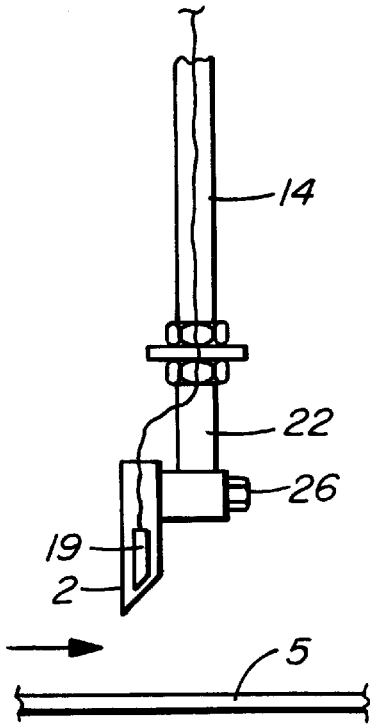
FIG. 3 is a detail view of another embodiment in which the sensors are installed in the slice lip.

In a still further arrangement, illustrated in FIG. 3, sensors 19 are installed in a passage formed in the slice lip 2 itself.

Figure 4:
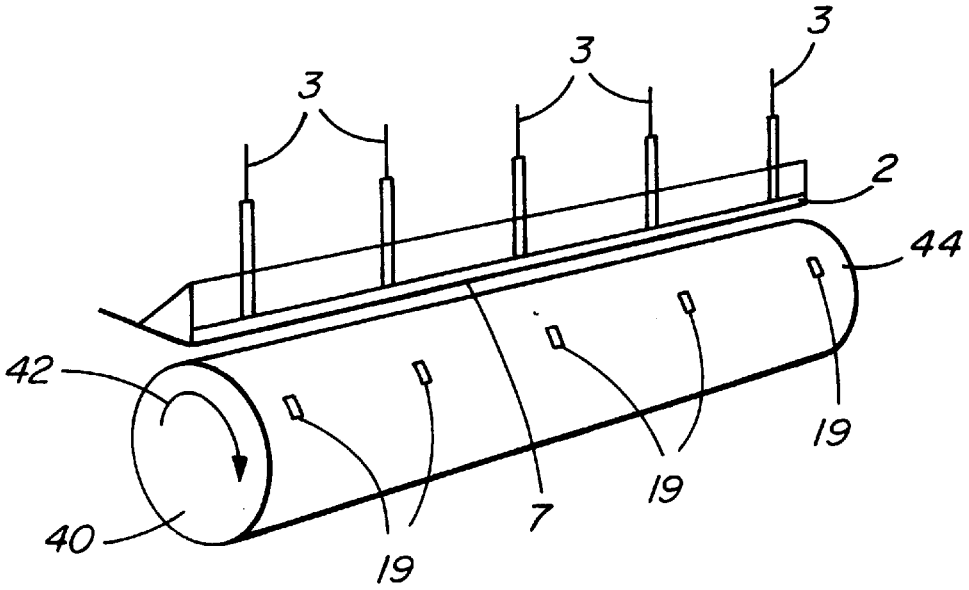
FIG. 4 is a detail view of a still further embodiment in which the apron is a rotating surface and the sensors are mounted in the apron.

FIG. 4 illustrates a still further alternative arrangement in which the gap regulation system of the present invention can be used. FIG. 4 shows a slice lip arrangement in which deformable slice lip 2 is positioned above a rigid surface that is movable. As in previous Figures, slice lip 2 is deformable by actuators 3. In FIG. 4, the rigid surface defining the apron comprises the external surface of a roll 40 that rotates in the direction indicated by arrow 42. Roll 40 includes sensors 19 embedded in the roll surface in a row 44. The sensors are preferably positioned to rotate directly below an actuator 3. In this illustrated arrangement, the gap 7 between the external surface of roll 40 and slice lip 2 is determined with appropriate processing of the signals generated by sensors 19 each time the row of sensors of the roll rotates past slice lip 2. Alternatively, sensors 19 can be mounted in the slice lip to continuously monitor the rotating rigid surface. The foregoing examples demonstrate that the gap regulation system of the present invention can be used in an environment where the rigid surface is movable.

It will be appreciated by those skilled in the art that the gap regulation system of the present invention is not limited to controlling the slice lip of a headbox in papermaking equipment. The present invention can also be used to maintain the gap on size presses, on coaters which extrude coating, on coaters which doctor off coating, on rod applicator coaters, or on extruders in the plastics industry. In the above examples, the apparatus and method of the present invention offers the potential for more uniform application of the product with local regulatory control of the gap through which the product is being dispensed. The supervisory level of control based on the downstream scanner measurements is used to bias the regulatory control necessary to correct any remaining variability not removed by maintaining a desired gap measurement profile.

By way of a further example, a particularly valuable application of the gap regulation system of the present invention would be in the control of the opening in Voith Sulzer™ coaters. This equipment requires a uniform gap opening to uniformly apply coating across the sheet. Setup and calibration of actuators to make a uniform gap as observed by visual inspection of the flow distribution takes several hours. This setup time can be dramatically reduced with installation of the apparatus of the present invention so that the gap can be regulated based on the sensor signals. In addition, relative CD coat weight control can be achieved without a scanning measurement of the coat weight profile on applications where this is difficult, impossible or impractical.

Other potential applications of the gap regulation apparatus and method of the present invention include zone-controlled gap regulation in the press section or a calendar, breast roll alignment, doctor blade alignment, and creping blade alignment and any other environment where there is a gap between two surface that can be varied by controlling actuators.

Although the present invention has been described in some detail by way of example for purposes of clarity and understanding, it will be apparent that certain changes and modifications may be practised within the scope of the appended claims.

I claim:

1. An apparatus for controlling the size of a gap through which material is metered, the gap being defined by a rigid surface and a flexible surface connected to at least one actuator for deforming said flexible surface, the apparatus comprising:

a plurality of sensors positioned along one of the rigid and the flexible surfaces to detect the other of the surfaces and generate signals indicating the position of the other surface;

computing means in communication with the plurality of sensors to process the signals to generate a continuous gap measurement profile and to store a predetermined desired gap measurement profile; and control means in communication with the computing means to actuate the at least one actuator to deform the flexible surface to adjust the gap measurement profile to correct deviation from the desired gap measurement profile.

2. Apparatus as claimed in claim 1 in which each of the plurality of sensors is an inductive proximity sensor.

3. Apparatus as claimed in claim 1 in which each of the plurality of sensors is a capacitive sensor.

4. Apparatus as claimed in claim 1 in which each of the plurality of sensors is an ultrasonic sensor.

5. Apparatus as claimed in claim 1 in which each of the plurality of sensors is laser sensor.

6. Apparatus as claimed in claim 1 in which the plurality of sensors are mounted in the rigid surface.

7. Apparatus as claimed in claim 6 in which each of the at least one actuator is connected to the flexible surface and corresponds to one of the plurality of sensors, and each of the sensors is positioned directly across the gap from the corresponding actuator.

8. Apparatus as claimed in claim 1 in which the plurality of sensors are mounted in the flexible surface.

9. Apparatus as claimed in claim 1 in which the gap is the slice lip opening at the headbox of a paper machine and the rigid surface is the apron and the flexible surface is the slice lip.

10. Apparatus as claimed in claim 9 in which the plurality of sensors are mounted in the apron.

11. Apparatus as claimed in claim 9 in which the plurality of sensors are mounted in the slice lip.

12. Apparatus as claimed in claim 9 in which each of the at least one actuators is connected to the slice lip at a clamp assembly and the sensors are mounted in the clamp assemblies.

13. Apparatus as claimed in claim 1 in which the rigid surface is movable.

14. Apparatus as claimed in claim 13 in which the rigid surface comprises an external surface of a rotating roll.

15. Apparatus as claimed in claim 1 in which the gap is an opening at a reservoir of a coater machine and the rigid surface is a gap extruder, and the flexible surface is a backing bar.

16. A method for controlling the size of a gap through which material is metered, the gap being defined by a rigid surface and a flexible surface connected to at least one actuator for deforming said flexible surface, the method comprising:

detecting one of the rigid and the flexible surfaces by sensors positioned along the other of the surfaces and generating signals indicating the position of the other surface;

analyzing the signals generated by the plurality of sensors to generate a continuous gap measurement profile:

comparing the gap measurement profile to a predetermined desired gap measurement profile; and manipulating the at least one actuator to deform the flexible surface to adjust the gap measurement profile to correct deviations from the desired measurement profile.

17. A method as claimed in claim 16 in which the steps are performed continuously in a local regulatory control loop.

18. A method as claimed in claim 17 including an additional supervisory control loop comprising the steps of:

measuring the properties of the material after metering through the gap by scanning the material at timed intervals to establish at least one measured property profile;

comparing the at least one measured property profile to a pre-determined desired property profile; and manipulating the at least one actuator to deform the flexible surface to correct for any deviations from the desired property profile each time a measured property profile is available.

* * * * *